US005084737A

United States Patent [19]

Hagen et al.

[11] Patent Number: 5,084,737

[45] Date of Patent: Jan. 28, 1992

[54] IMAGE TRANSFER METHOD AND APPARATUS WHEREIN THE APPLICATION OF THE TRANSFER BIAS IS DELAYED AS A FUNCTION OF HUMIDITY

[75] Inventors: William J. Hagen, Rochester; William Y. Fowlkes, Henrietta, both of N.Y.

[73] Assignee: Eastman Kodak Company, Rochester, N.Y.

[21] Appl. No.: 587,205

[22] Filed: Sep. 24, 1990

[51] Int. Cl.[5] ..... G03G 15/16

[52] U.S. Cl. ..... 355/274; 355/208; 355/272; 355/312; 355/326

[58] Field of Search ..... 355/273, 274, 208, 312, 355/271, 215, 30, 272, 275, 326; 430/126

[56] References Cited

U.S. PATENT DOCUMENTS

| | | | |
|---|---|---|---|
| 3,702,482 | 11/1972 | Dolcimascolo et al. | 355/271 |
| 3,781,105 | 12/1973 | Meagher | 355/274 |
| 3,837,741 | 9/1974 | Spencer | 355/274 |
| 3,924,943 | 12/1975 | Fletcher | 355/273 |
| 4,338,017 | 7/1982 | Nishikawa | 357/273 |
| 4,453,841 | 1/1984 | Bobick et al. | 355/319 X |
| 4,674,860 | 6/1987 | Tokunaga et al. | 355/274 |
| 4,712,906 | 12/1987 | Bothner et al. | 355/271 |
| 4,740,813 | 4/1988 | Roy | 355/274 |
| 5,036,360 | 7/1991 | Paxon et al. | 355/208 |
| 5,040,029 | 8/1991 | Rodenberg | 355/271 |

FOREIGN PATENT DOCUMENTS 0062465 5/1980 Japan .

*Primary Examiner*—A. T. Grimley
*Assistant Examiner*—J. E. Barlow, Jr.
*Attorney, Agent, or Firm*—Leonard W. Treash, Jr.

[57] ABSTRACT

Toner images are transferred in registry to a receiving sheet held on a transfer drum which drum has one or more layers which varies in resistivity. To offset difficulties in initial securing of the sheet to the drum, a transfer field is not applied as the leading edge of the sheet attaches to the drum. The transfer field is applied after a predetermined delay, which delay is varied as a function of the resistance of the drum.

11 Claims, 6 Drawing Sheets

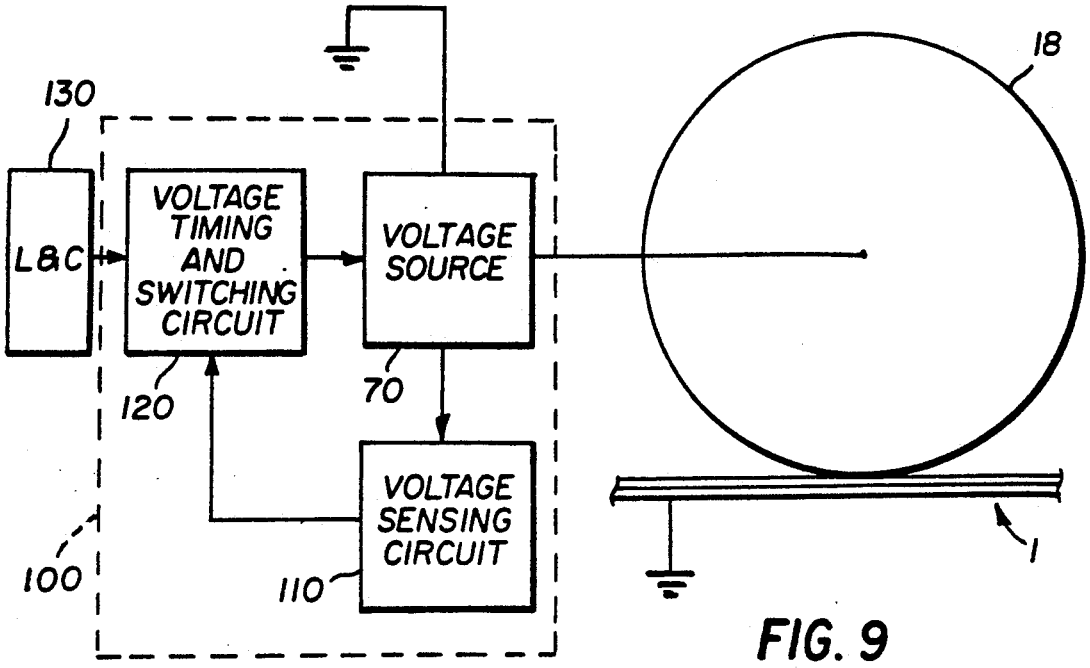
FIG. 9
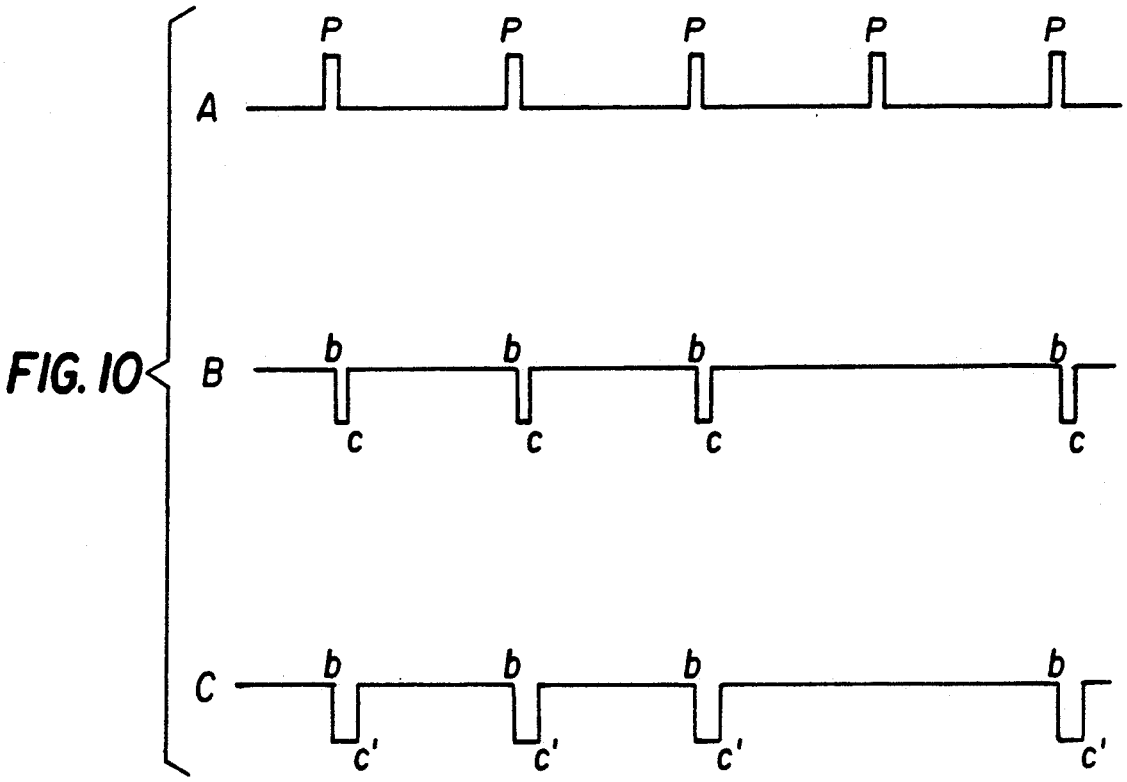

IMAGE TRANSFER METHOD AND APPARATUS WHEREIN THE APPLICATION OF THE TRANSFER BIAS IS DELAYED AS A FUNCTION OF HUMIDITY

TECHNICAL FIELD

This invention relates to the transfer of toner images to a receiving sheet carried on a transfer drum. It is especially useful in the transfer of several color toner images in registration to a receiving sheet to form a multicolor image.

BACKGROUND ART

Electrophotographic color reproductions are conventionally made by forming monocolor toner images of different color on an image member and transferring those images in registration to a single receiving sheet. The receiving sheet is held by a transfer drum, usually with gripping fingers, which is rotated to bring the receiving sheet repetitively into transfer relation with the image member in a nip to overlay the toner images. Transfer is accomplished by an electric field in the nip having a direction urging the toner to move to the surface of the receiving sheet.

The field in the nip attracts the toner to the paper. At the same time, the field causes the paper to be attracted to the image member, which contributes to forces tending to cause the paper to follow the imaging member rather than the transfer drum.

Once the paper has been intimately held by the transfer drum, the paper can become electrostatically attracted to the drum and be difficult to remove. These competing forces vary with temperature and humidity. Thus, the industry has found great difficulty in controlling the paper in color transfer apparatus of this type, especially apparatus designed to operate in varying conditions over long runs with no paper jams. The industry approaches this difficulty by feeding the paper into contact with the drum well prior to the nip and gripping the paper with small fingers forming part of the drum to hold the paper securely. The fingers hold the paper until all transfers have been made and the paper has left the nip for the last time. At that point the fingers release the paper and paper separating skives separate the paper from the transfer drum. Although this approach has the advantages of reasonable certainty in holding the paper and releasing the paper, the gripping fingers on the transfer drum add complexity and the skives have a tendency to wear the drum.

Some color systems do not lend themselves to the use of gripping fingers at all. For example, U.S. Pat. No. 4,712,906, Bothner et al, issued Dec. 15, 1987, shows an electrophotographic color printer which forms consecutive images in different colors that are transferred in registry to a receiving sheet. The receiving sheet is wrapped around a transfer drum and recirculated on the surface of the drum into transfer relation with the consecutive images to create a multicolor image on the sheet. To improve efficiency, large sheets, for example "ledger" size sheets are placed on the drum with the small dimension parallel to the axis of the drum and wrapped substantially around the transfer drum. Small sheets, for example, "letter" size sheets, are placed with their long dimension parallel to the axis of the drum. Since the short dimension of letter size sheets is half the long dimension of ledger size sheets, two letter size sheets are placed on the drum in approximately the same space as the single ledger size sheet.

The Bothner invention is difficult to utilize with gripping fingers because the leading edge of the second letter size sheet is positioned at approximately the middle of a ledger size sheet. For some applications, retractable fingers may be made to work, but for many applications they would leave substantial image artifacts in a ledger size sheet. Bothner therefore suggests the use of vacuum holes which are positioned at the leading edge of each of the smaller sheets and may or may not both be activated for the ledger size sheet.

The Bothner structure, as described, works well for most environments. However, in some temperature and humidity conditions found in some locations difficulty is encountered both with initial pickup by the transfer drum of the transfer sheet and release of the transfer sheet from the transfer drum as the last image is being transferred.

U.S. Pat. No. 4,674,860 to Tokunaga et al issued June 23, 1987 shows a transfer drum to which a receiving sheet is tacked electrostatically by spraying electrostatic charge on either the sheet or the drum or both. The bias on the transfer drum is switched between positive and negative to initially attract the sheet which has been charged and later to attract the toner to the sheet.

U.S. Pat. No. 4,740,813 to Roy issued Apr. 26, 1988 shows a transfer drum using vacuum holes in which the vacuum portion of the drum is not biased when in the nip to aid in the location of the leading edge and trailing edge of the receiving sheet.

Prior filed U.S. patent application Ser. No. 430,037 now U.S. Pat. No. 5,040,029, to Rodenberg et al, filed Nov. 1, 1989, describes a method of forming multicolor toner images in which the leading edge of the receiving sheet is attracted by a vacuum to the transfer drum. Immediately upon attraction of the leading edge to the drum, the transfer field is applied. In a preferred embodiment the transfer field is removed as the leading edge passes through the nip for subsequent transfers to prevent it reattaching to the photoconductor. As the last image approaches the transfer nip, the field is maintained as the vacuum is released and the transfer sheet follows the image member rather than the transfer drum from which it is later separated.

DISCLOSURE OF INVENTION

This invention is a further development on that Rodenberg et al invention. In perfecting the approach disclosed in the Rodenberg et al application, it was found that both the reliability of pickup of the leading edge of the paper by the transfer drum and the density of the portion of the transferred image at the leading edge of the receiving sheet was substantially affected by ambient relative humidity. In extremely dry conditions, for example, ten percent relative humidity, weak transfer was observed at the leading edge of the image.

It is the object of the invention to provide both a method and apparatus similar to that described in the earlier Rodenberg et al application but in which this condition of weak transfer at the leading edge of an image is not experienced even at conditions of very low relative humidity.

These and other objects are accomplished by varying the timing of the application of the transfer field as a function of either the relative humidity or the resistance of a portion of the transfer drum.

We believe that the problems encountered at low relative humidities are due to an increased resistance at such humidities of the surface layers of the transfer drum. That is, a transfer drum manufactured with an aluminum core upon which are one or more layers of an intermediate conductivity material such as polyurethane, commonly will vary in resistance according to the relative humidity and temperature. An increase in humidity causes moisture to be absorbed by the polyurethane, making it more conductive. An increase in temperature reduces the resistance of the polyurethane. When a voltage is applied to the core, the polyurethane layer and the conductive backing on the original image member form a simple RC circuit. The time required for the transfer field to reach full application varies according to the resistance of the polyurethane layer. This resistance is higher in conditions of low humidity and/or temperature. Thus, if a transfer field switch is closed according to nominal timing, the full transfer field will be applied later in such conditions. At the same time, pickup of the transfer sheet is somewhat easier in conditions of low humidity because the sheet itself is less conductive and adheres more readily to the polyurethane layer. Accordingly we have found that if the bias establishing the electrical field is applied sooner in the timing cycle in conditions of low humidity or when the drum is more insulating than it is in conditions of high humidity or when the drum is more conductive, the process in general works much better over a range of ambient conditions.

According to a preferred embodiment, the invention is applied to a transfer system in which the transfer bias itself varies as a function of the resistance of the transfer drum. For example, a conventional constant current transfer system uses a constant current source and results in a varying bias according to the resistance of the drum. A voltage sensing circuit is used to sense the voltage on the transfer drum when a machine is turned on and is operating at the beginning of a copying period. In response to the voltage sensed on the transfer drum, appropriate logic then times the application of the transfer electric field for the rest of that copying or printing period. With such a system, the timing can be varied continuously as a function of the transfer voltage on the transfer drum which, in turn, is a function of the resistance of the intermediate conductivity layer or layers on the transfer drum, which, in turn, is a function of the relative humidity or temperature.

BRIEF DESCRIPTION OF THE DRAWINGS

In the detailed description of the preferred embodiment of the invention presented below reference is made to the accompanying drawings, in which:

FIG. 9 is a side schematic of the transfer station including a schematic circuit diagram of the transfer field applying and timing structure.

FIG. 10 is a timing diagram illustrating the application of the transfer field according to the invention.

BEST MODE OF CARRYING OUT THE INVENTION

Figure 1:
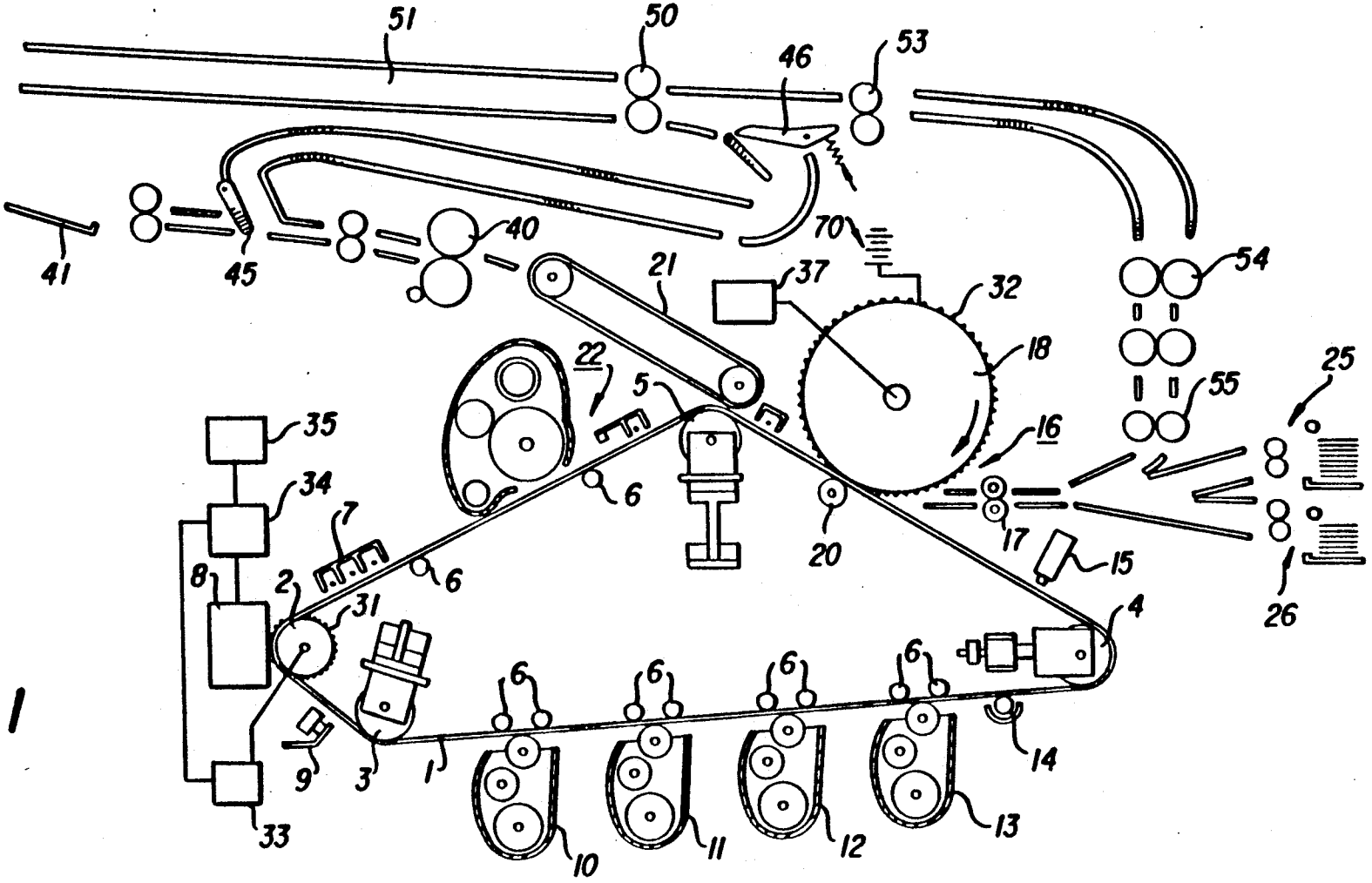
FIG. 1 is a schematic side view of a printer constructed according to the invention, with many parts eliminated for clarity of illustration.

According to FIG. 1 a film core portion of a copier or printer includes an image member, for example, an endless photoconductive web 1 entrained about a series of primary rollers 2, 3, 4 and 5, and other supporting structure, for example, film skis 6. Photoconductive web 1 may include known photoconductive layers on a conductive backing on a suitable support.

Web 1 is driven through a series of electrophotographic stations generally well-known in the art. More specifically, a uniform charge is laid down on the web 1 by a charging station 7. The uniformly charged web moves around printhead roller 2 which is directly opposite an LED printhead 8 which LED printhead exposes the web 1 in a manner well-known in the art. The web then moves into operative relation with an electrometer 9 which senses the level of a charge existing after exposure of the web by printhead 8, to help control the process.

The web then moves into operative relation with a series of toning or developing stations 10, 11, 12 and 13. Each image created by printhead 8 is toned by one of the toning stations. After being toned the web passes a magnetic scavenger 14 which removes excess iron particles picked up in the toning process. After the electrostatic image has been toned the web passes under a densitometer 15 which measures the density of the toner image, also for use in controlling the process. The toner image then proceeds to a transfer station 16 where the image is transferred to a transfer surface of a receiving sheet carried by a transfer drum 18.

The transfer drum 18 includes vacuum holes 19 (FIGS. 2–3) for securing the receiving sheet thereto for repeated presentations to web 1. The transfer drum 18 cooperates with web 1 to incrementally bring the receiving sheet and the toner image into transfer relation so that the toner image is transferred to the receiving sheet. As is well known in the art, this is generally accomplished in the presence of an electric field which is created by biasing the transfer drum by a suitable biasing means, for example, electrical source 70, compared to the conductive backing of the web 1 or to a backing roller 20 for the web. This process has been well-known in the art for many years, see for example, U.S. Pat. No. 3,702,482 to Dolcimascolo et al issued Nov. 7, 1972. Although either the web 1 or the drum 18 could be at ground, conventionally the conductive backing is at ground and the drum at a relatively high voltage. For example, if the toner to be transferred is positively charged, the drum can be biased to −2000 V by electrical source 70.

As thoroughly discussed in U.S. Pat. No. 4,712,906, cited above, when the apparatus is operating in a multi-image mode, for example, a multicolor mode, consecutive images or pairs of images are toned with different colored toners using the different toning stations 10–13. These consecutive images are transferred in registry to the receiving sheet as it repeatedly is brought into transfer relation with the web 1 by the drum 18. After the transfer operation is complete, the receiving sheet is allowed to follow the web. The receiving sheet is separated from the web with the aid of an electrostatic sheet transport mechanism 21 and is transported to a fuser 40. The web is then cleaned by the application of a neutralizing corona and a neutralizing erase lamp and a magnetic brush cleaning mechanism all located at a cleaning station 22.

Figure 2:
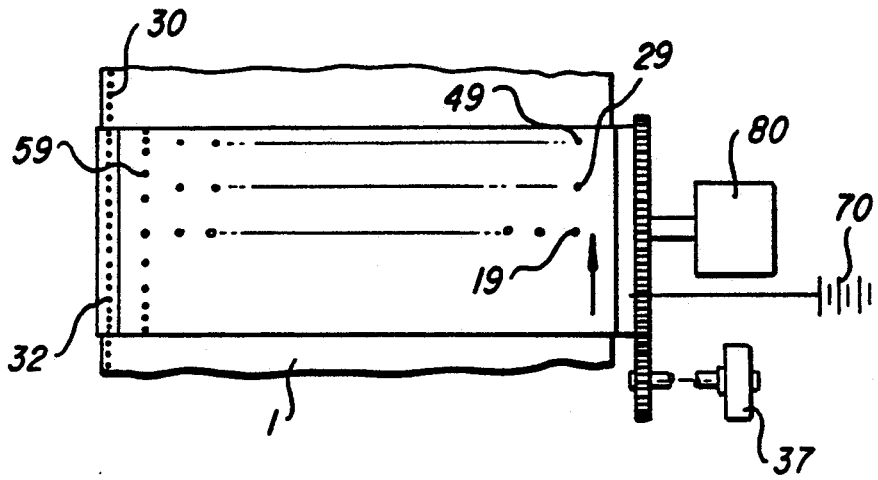
FIG. 2 is a top view of a portion of a transfer apparatus in which the invention is useable.

The transfer drum 18 is driven by a motor 37. The drum 18 in turn drives the web 1 through a sprocket 32 which engages perforations 30 (FIG. 2). The sprocket 32 also forms part of a registration and timing system which includes a sprocket 31 on printhead roller 2 which sprocket is linked to an encoder 33. The encoder 33 feeds signals indicative of the angular position of sprocket 31 to a drive 34 for the printhead 8 which drive 34 times the application of information from an information source 35 to the printhead 8.

After the receiving sheet leaves the fuser 40 it can go directly to an output tray 41 or be deflected by a deflector 45 into a duplex path according to the position of deflector 45, the position of which is controlled by the logic of the apparatus through means not shown. The duplex path moves the sheet by rollers and guides directing it first through a passive deflector 46 into turn-around rollers 50. Turn-around rollers 50 are independently driven to drive the receiving sheet into turn-around guide means 51 until the trailing edge thereof has been sensed by an appropriate sensor, not shown, to have passed passive diverter 46. Once the trailing edge has passed passive diverter 46 the turn-around rollers 50 are reversed and the receiving sheet is driven by rollers 50 and other sets of drive rollers 53, and 54 back to a position upstream of the transfer station 16. The receiving sheet can pass through registration mechanisms for correcting for skew, crosstrack misalignment and in-track misalignment and ultimately stop at alignment rollers 55.

Transfer station 16 receives sheets from any of three sources. First, it can receive sheets of one particular size from a first supply 25, which first supply may include, for example, letter size sheets being fed with their short dimension parallel with the direction of feed. Second, it may receive sheets from a second supply 26, which, for example, may include ledger size sheets with their long dimension parallel to the direction of feed. Third, the transfer station 16 may receive sheets from the duplex path as controlled by rollers 55 which may include either size sheet and would already contain a fused image on its upper side. The receiving sheets from whatever source, stop against timing rollers 17. In response to a signal from the logic and control of the apparatus, not shown, timing rollers 17 accelerate to drive the receiving sheet into the nip between the transfer drum 18 and the web 1 as the first toner image to be transferred approaches the nip.

The duplex path is of a length that takes multiple sheets at one time depending on the length of the sheets. For example, four letter size sheets may be in the duplex path at one time or two ledger size sheets. If the printer is printing different images on different sheets, the logic and control of the apparatus must supply the necessary programming to the exposure and toning stations so that the sheets ultimately fed to the output tray 41 are in the correct order considering the number of sheets that must be in the duplex path. Such programming is known in the art, see, for example, U.S. Pat. No. 4,453,841.

Figure 3:
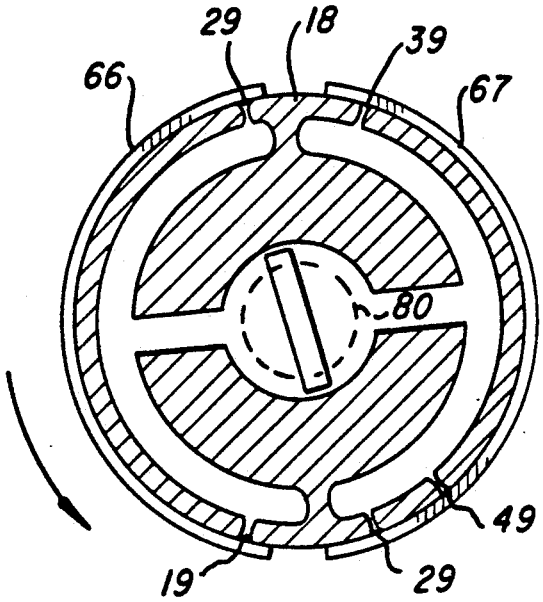
FIG. 3 is a partially schematic cross-section of a transfer drum shown in FIG. 2.

The vacuum system for transfer drum 18 is best seen in FIGS. 2 and 3. According to FIG. 2, vacuum holes 19 are positioned across the length of drum 18 to grip the leading edge of a receiving sheet. Vacuum is applied to the holes from a source of vacuum shown schematically at 80 through suitable conduits and valves, some of which are not shown. U.S. Pat. No. 4,712,906 is incorporated by reference herein and shows more details of a suitable mechanism for applying and releasing the vacuum at the appropriate times for the holes gripping the leading edges of receiving sheets.

The drum 18 has an aluminum core and a polyurethane outer layer. Preferably, the polyurethane is of an intermediate resistivity, for example, it may have a resistivity of $5\times10^9$ ohms-cm at 70 degrees F. and at 50 percent relative humidity. Transfer rolls having an outer layer or layers of intermediate resistivity are well known and have certain advantages over drums having greater conductivity. The outer layer in the Figs. is shown as a single layer, but can be more than one. See, for example, U.S. Pat. No. 3,781,105, Meagher, issued Dec. 25, 1973 for a discussion of advantages of intermediate conductivity (resistivity) transfer drums and illustrating use of a two outer layer drum. The polyurethane layer (or layers) is sufficiently conductive that it helps establish the electrical field urging transfer.

As seen in FIG. 3, vacuum holes 19 grip the leading edge of a first letter sized receiving sheet 66 which encompasses slightly less than half the circumference of the drum 18. The leading edge of a second letter size sheet 67 is gripped by another row of vacuum holes 39. For many grades of paper, vacuum holes for the leading edge are adequate. However, for best holding of a wide grade of materials, including transparency stock, vacuum holes 29 located along the trailing edge of the sheets assist in the holding process, preventing creep of the receiving sheet on the drum surface and thereby preventing misregistration of images. Additionally, a set of vacuum holes 59 (FIG. 2) can be positioned along one or both lateral edges of the image areas to provide additional holding force.

If a ledger sized receiving sheet is to be used, the leading edge is still attached using vacuum holes 19 but, the sheet will stretch across one row of holes 29 and the row of holes 39 ending up short of the second row of holes 29. To secure the trailing edge of ledger-sized sheets, an additional row of holes 49 is provided. If the trailing edge of other sizes of sheets (for example, legal size) is to be secured, additional rows of holes for those trailing edges will be necessary.

As described in the Bothner et al patent, as the last image enters the nip, the vacuum is removed to allow the receiving sheet to follow the image member.

As described in U.S. patent application Ser. No. 430,037, now U.S. Pat. No. 5,040,029, cited above, a problem is encountered at some conditions of temperature and humidity at this point. An occasional receiving sheet has become so intimately attached to the drum it does not follow the web and stays with the drum. This ultimately jams the apparatus. Although the jam may be readily clearable by the operator, modern printers and copiers are not content with even one such jam in a thousand sheets.

To correct this problem, the polyurethane surface of transfer drum 18 has been made rough by grinding, such that peaks and valleys on the surface are separated by at least 0.002 inches. This textured surface acts as a spacer, providing small air gaps between the surface of the drum and the paper. The air gaps allow some ionization of air to take place in the transfer nip itself between the paper and the drum. This appears to improve the efficiency of transfer of the toner to the paper and significantly reduce the electrostatic attraction of the paper to the drum surface. In addition, it is believed that the ionization injects charge on the back side of the paper tending to tack the paper to the image member. In essence, it makes the paper less attracted to the drum and more easily released from it. With the roughened surface, runs in excess of 20,000 sheets have been accomplished in a variety of temperatures and humidities without a failure to release when the vacuum is removed.

With peaks and valleys in excess of 0.005, the sheet still reliably releases when the vacuum is removed. However, the texture can show up on the image. Thus, for applications where such texture is undesirable, a surface with 0.002 to 0.005 inches separation between peaks and valleys is desirable.

The roughened surface can be created by means other than grinding. For example, a nylon stocking secured around the drum eliminated release failures. (However, if the stocking was too coarse, the texture showed in the image.) Other such cloth materials could be used. Small roughening particles can be molded in or coated to the polyurethane surface.

Unfortunately, this roughened surface makes somewhat more difficult initially attaching the leading edge of the receiving sheets to drum 18. That is, at some temperatures and humidities, the sheet follows the image member despite the presence of the vacuum. FIGS. 4–8 describe the solution, disclosed in U.S. patent application Ser. No. 430,037, now U.S. Pat. No. 5,040,029, to the problem by the texturizing of the surface.

Figure 4:
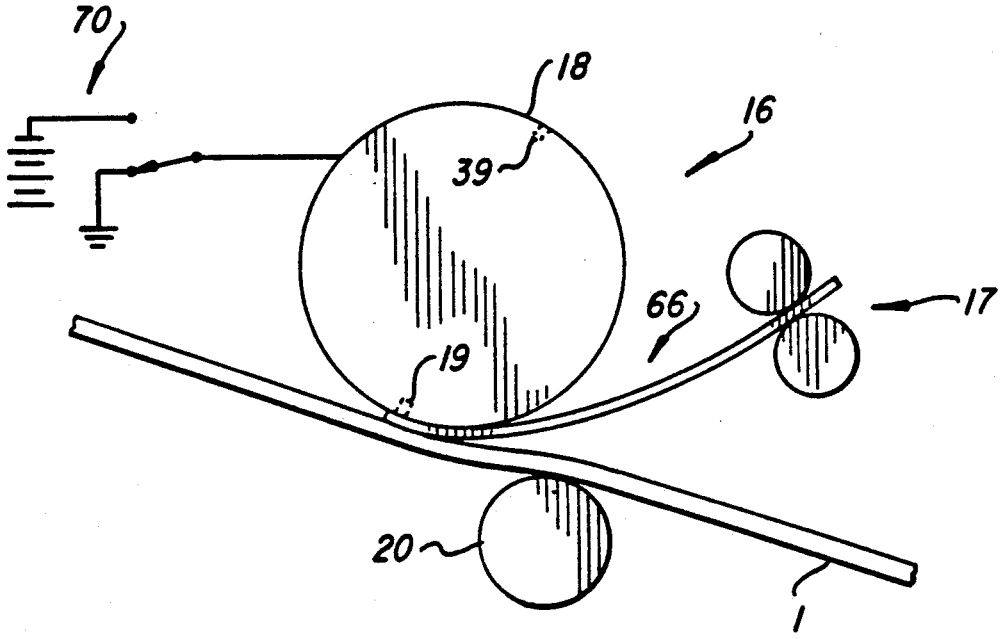
FIGS. 4 and 5 are cross-sections of the transfer station and surrounding environment illustrating the adjustment of the transfer bias.

According to FIG. 4 a first receiving sheet 66, a letter size sheet with its short dimension in the in-track direction, is fed by roller 17 into the nip between transfer drum 18 and image member 1 in timed relation with the arrival in the nip of vacuum holes 19. Preferably, the receiving sheet 66 engages the drum 18 slightly before the nip, at which point the vacuum is applied through holes 19 to secure the leading edge of sheet 66 to the drum.

According to FIG. 4, while the leading edge of receiving sheet 66 is in the nip the transfer drum is grounded (through a switch shown in FIGS. 4–8 as part of power source 70) and vacuum applied through holes 19. Under these conditions the leading edge is attached to the drum and separates from the image member 1 as the sheet 66 begins to exit the nip.

Figure 5:
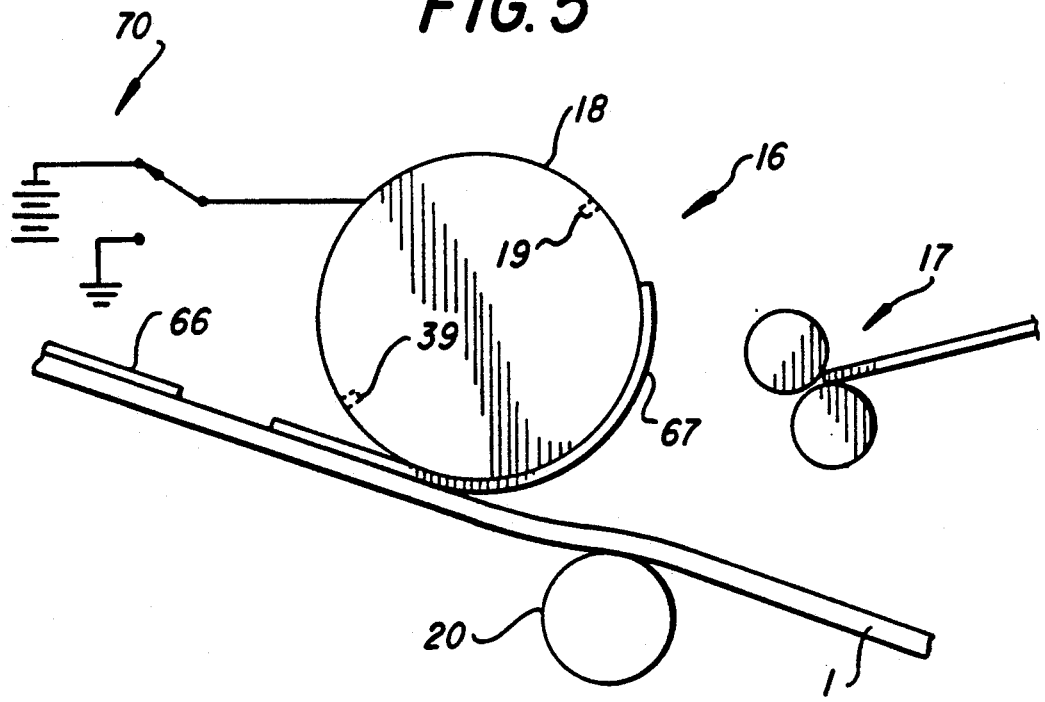

Just after the receiving sheet 66 exits the nip and the leading edge separates from image bearing member 1 the power source 70 which applies the transfer bias to drum 18 is switched from its position shown in FIG. 4 where it is grounded to its position shown in FIG. 5 where it applies a suitable transfer bias to drum 18. The transfer bias is not applied until the leading edge has released from image bearing member 1 to prevent that bias from causing the receiving sheet 66 to be so attracted to image bearing member 1 that it will not release from it and will follow image bearing member 1 rather than be tacked to the transfer drum. However, after the leading edge has separated from the image member 1, the vacuum through holes 19 is sufficient to maintain the leading edge of sheet 66 securely on drum 18 as drum 18 rotates. The second receiving sheet 67, also letter size with its short dimension in the in-track direction is similarly fed into contact with drum 18 as vacuum holes 39 approach the nip. Again, as the leading edge of receiving sheet 67 is just exiting the nip the voltage source 70 is switched to the position shown in FIG. 4 to remove the transfer field from the nip so that the leading edge of receiving sheet 67 is not encouraged to follow image bearing member 1.

With both sheets 66 and 67 attached to drum 18 the drum rotates through several revolutions as a plurality of different colored images are transferred to the sheets. As the last image to be transferred to first receiving sheet 66 approaches the nip, the vacuum to holes 19 is switched off while leaving the transfer field from source 70 on. The transfer field assists in forcing the leading edge of receiving sheet 66 to follow image bearing member 1 and separate from transfer drum 18. Similarly, when the second receiving sheet 67 reaches the nip the vacuum applied through holes 39 is switched off and the receiving sheet similarly follows image bearing member 1 as shown in FIG. 5.

Although a single bias is shown on voltage source 70, it is well recognized in the art that different biases may be appropriate for transfers of different colored images because of variations in the toner or because of previous images already transferred to the receiving sheets. It is also understood that ground is an arbitrary voltage. Thus, the ground position for voltage source 70 could be replaced by a lower voltage of the same polarity as the transfer voltage or a voltage of opposite polarity.

If the transfer drum 18 were smooth, it would be easier to secure receiving sheets 66 and 67 to the smooth surface. For most humidities and temperatures, no bias adjustment would be necessary to secure a sheet to a smooth transfer surface. However, it is difficult to release the receiving sheet from a smooth transfer surface in many humidity-temperature conditions. As described above, the drum surface is texturized or roughened to make easier the release of the transfer sheets in the FIG. 5 situation. Because of the textured surface, the bias is switched off as shown in FIG. 4 to initially secure the transfer sheets to the roughened surface of transfer drum 18.

Figure 6:
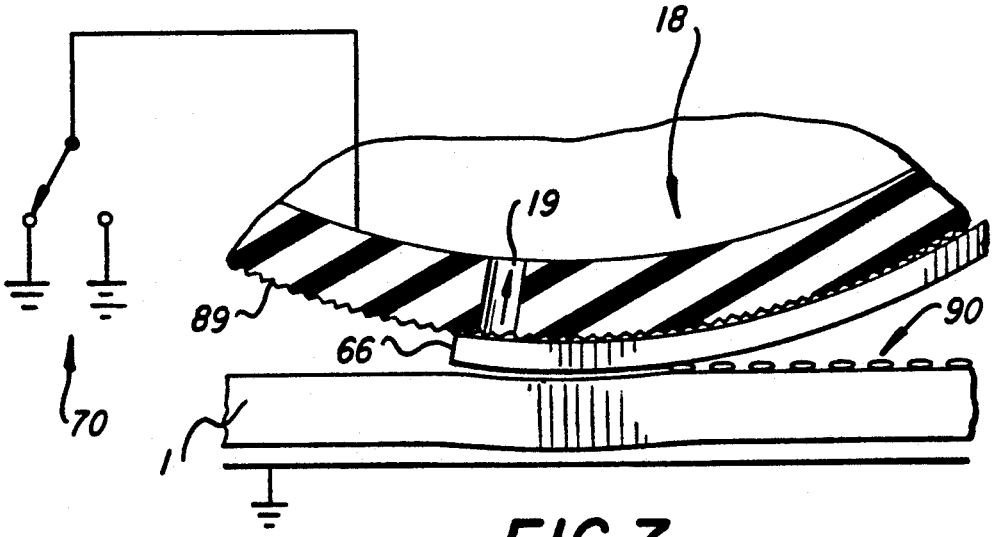
FIGS. 6–8 are partially schematic sections, with some dimensions exaggerated, of the transfer nip illustrating the forces on a receiving sheet in the initial attaching, transfer, and release conditions of the sheet, respectively.
Figure 7:
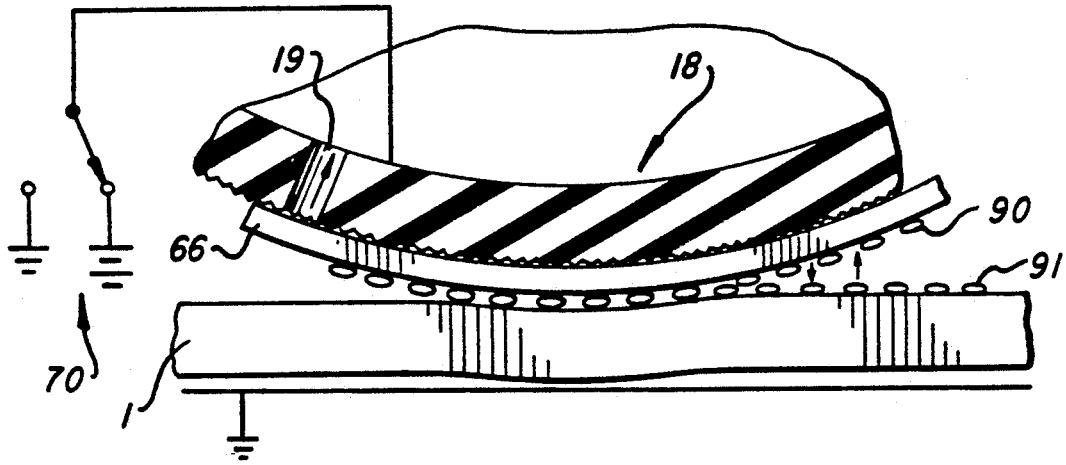
Figure 8:
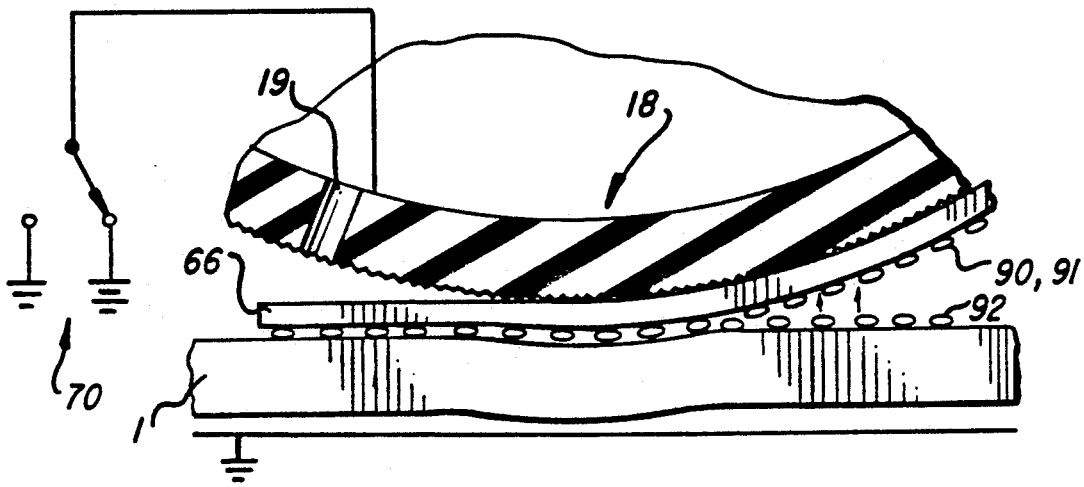

This is also illustrated in FIGS. 6–8. According to FIG. 6, the leading edge of receiving sheet 66 is just leaving the nip as the first toner image 90 enters the nip. The surface 89 of drum is has been roughened making adherence of the sheet 66 to it more difficult. However, no transfer voltage is applied from source 70. A vacuum shown by an arrow in hole 19 controls, and the sheet separates from image member 1 despite the roughened surface.

After the first, say 0.25 inches of the sheet (exaggerated in FIG. 6) has passed a nominal point in the nip, the transfer voltage is applied.

Two or more images 90 and 91 are transferred in registration as shown in FIG. 7 by the electrical attraction created by the field between the paper and the toner. For best results over a variety of ambient conditions, the drum is grounded for a short time each time the leading edge of a receiving sheet exits the nip except the last one.

As shown in FIG. 8 as the last image 92 to be transferred to this sheet reaches the nip, the vacuum is cut off. The transfer field attracts the paper to the image member facilitated by the roughened surface of drum 18.

Preferably, the printhead 8 does not write on the beginning 0.25 inches of the image, a portion in the margin in most reproductions. However, since the last image is not affected by the grounding, the apparatus could be programmed to write one color, for example, black, to the edge of the sheet.

Thus, these two mechanisms, a roughened surface on transfer drum 18 and a removal of the transfer bias during initial securing of the leading edge of the receiving sheets, provide a transfer station with high reliability with a vacuum as the securing force. Skives or gripping fingers are not necessary. The reliability of the transfer mechanism described in the Bothner patent is maintained through a large variety of humidities and temperatures.

FIG. 9 illustrates an improvement with respect to the apparatus described in FIGS. 1–8. It is known to use a constant current source for applying a voltage to a transfer drum of the type shown in FIGS. 1–8. See, for example, U.S. Pat. No. 3,837,741. Since the resistivity of the drum material varies with changes in humidity and temperature, the voltage applied to the drum to maintain a constant current likewise varies with humidity and temperature. U.S. patent application Ser. No. 482,612, filed Feb. 21, 1990 now U.S. Pat. No. 5,036,360, to J. F. Paxon et al, describes a mechanism for sensing the voltage provided by the constant current source and for locking that voltage for the rest of a particular production run and using that voltage to adjust other humidity sensitive parameters of the system.

Using the system shown in FIGS. 1–8 with a polyurethane transfer roller, somewhat less transfer was noticed at the leading edge of those images transferred under low humidity conditions. In conditions of higher humidity, transfer was more complete from the intended point of field application. We concluded that the increased resistance of the polyurethane outer layer of the transfer drum had caused a delay in effective application of the field in the low humidity condition. That is, the transfer nip is part of a RC circuit having a higher time constant when the resistance is higher. This delay in obtaining a full transfer voltage resulted in incomplete transfer at the very beginning of the image when low humidity (or temperature) increased the resistance of the transfer drum.

According to FIG. 9, this problem is cured by a timing circuit 100 which includes the voltage source 70 which is connected to the core of drum 18. During a copying run, the voltage applied by voltage source 70 will vary according to the resistance of the polyurethane or other intermediate conductivity layer or layers on transfer drum 18. That voltage at any given time is sensed by voltage sensing circuit 110 and fed back to a voltage timing circuit 120. Voltage timing circuit 120 is actually a simple delay circuit which receives from a logic and control 130 of the copier/printer a timing pulse indicating arrival of the leading edge of a receiving sheet at a nominal point associated with entrance to the transfer nip. The voltage timing and switching circuit applies a delay to the signal received from the logic and control 130 and switches the voltage source 70 to an ON position at the end of the delay, applying the field to the transfer nip. The size of the delay is adjusted according to the voltage sensed by voltage sensing circuit 110 which, in turn, is a function of the resistance of the polyurethane layer or layers on transfer drum 18 which, in turn, is a function of the ambient humidity (or temperature). The higher the voltage (indicating a higher resistance), the shorter the delay to give the field more time to rise to an effective level.

This is best illustrated by a timing diagram shown in FIG. 10. Logic and control 130 feeds a pulse P, shown on chart A, indicative of the beginning of each of a set of new images passing a predetermined nominal position associated with the beginning of the transfer nip. According to charts B and C, the transfer voltage is switched OFF at the same point b as the receiving sheet enters the nip. However, according to chart B a high output voltage is sensed because of low relative humidity and a higher resistance of the polyurethane layer or layers. In this condition, according to line B, the transfer voltage is applied at point c after a short delay which can be while the leading edge of the receiving sheet is in the nip. Because of the time it takes for the field to rise when the polyurethane is of higher resistance, the field reaches an effective level after a further delay adequate for the vacuum to secure the leading edge to the drum. According to chart C, in a condition of high humidity a longer delay is used before the transfer voltage is applied at c'. In such condition, the polyurethane is of lower resistance and the field rises faster, reaching an effective level at a time also after the leading edge is secure to the drum. (The size of the delays are exaggerated in FIG. 10 for purposes of illustration.) As shown in FIG. 10, the voltage is not reduced at the beginning of the fourth image so that the sheet will follow image member 1.

Figure 11:
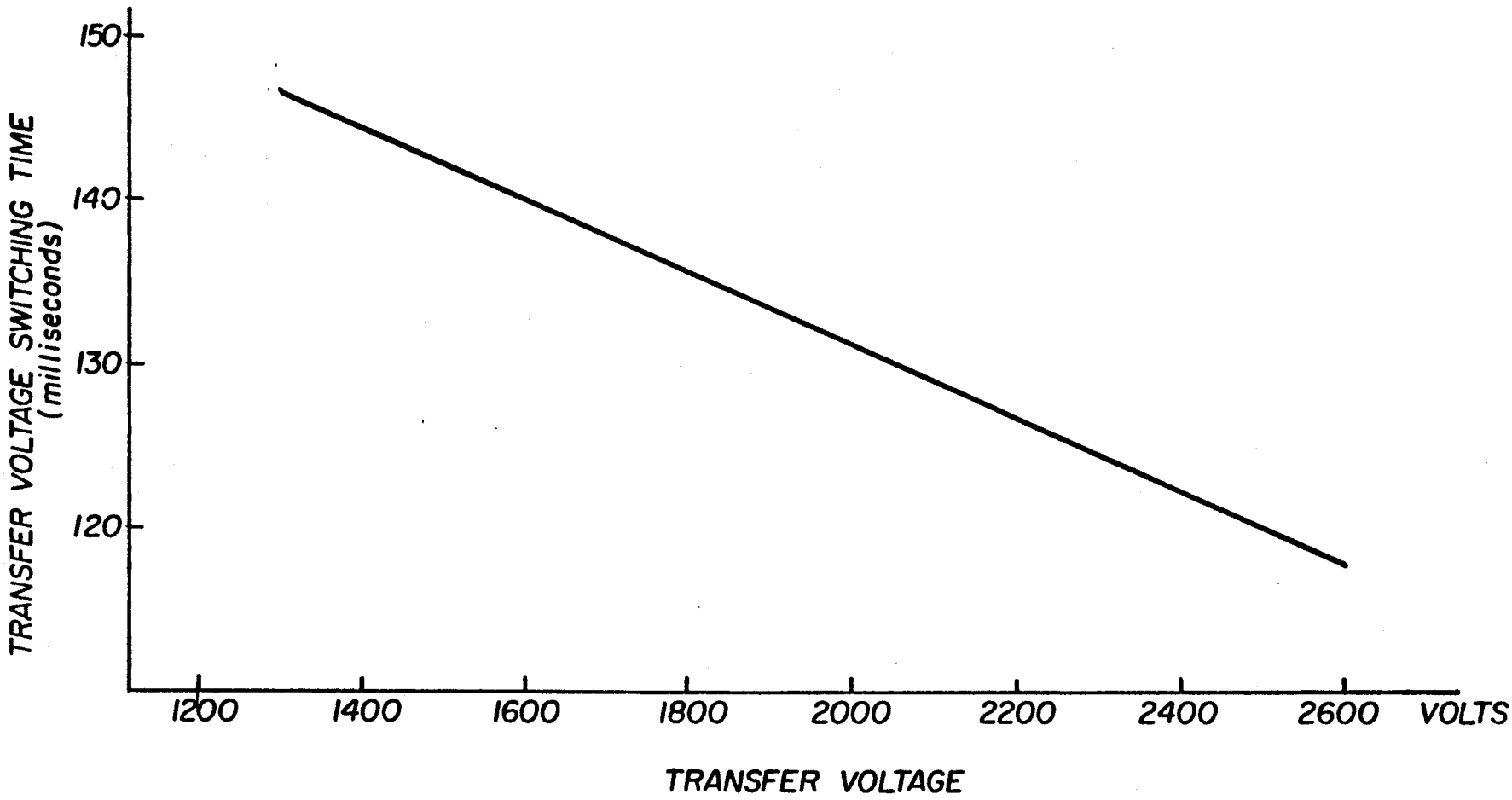
FIG. 11 is graph plotting time of application of the transfer field against sensed transfer voltage.

The amount of the delay can be adjusted according to the parameters of any system. However, FIG. 11 illustrates one example using a polyurethane transfer roller whose surface resistivity varies from approximately $10^9$ ohms-cm to $10^{10}$ ohms-cm and whose bulk resistivity varies from between 10 to 100 megaohms according to relative humidity and temperature. According to FIG. 11, as the transfer voltage from a constant current source varies from 1,300 volts to 2,600 volts, the delay time is reduced by 40 milliseconds. The later application of the transfer voltage in the high humidity condition provides an adequate portion of the receiving sheet to be attached to the transfer drum prior to application of that voltage, thereby assuring pickup of the receiving sheet. Since pickup of the receiving sheet is most difficult in high humidity situations, this extended delay is useful. At the same time, the shortened time for application of the voltage (chart B) in the low humidity (or low temperature) condition provides a longer time for the field to reach its full value which is desirable because of the increase in resistance of the transfer drum. Because a paper receiving sheet has a higher resistance in a low humidity condition, pickup is easier and any shortness of the delay does not prove troublesome.

It will be clear to somebody skilled in the art that the variation in the delay in applying the transfer voltage can be a discontinuous function including a few or many steps as well as the continuous function shown in FIG. 11. It will also be clear that this adjustment can be made for each image, run, or day without utilizing particularly sophisticated circuitry. However, humidity (and temperature) ordinarily vary somewhat in a copying or printing environment. Accordingly, it is preferable that the voltage applied to the drum 18 by a constant current source 70 be sensed during each cycle-up of a copier or printer. That sensed voltage is then used to set the appropriate timing for the apparatus for that cycle.

Although the delay is preferably adjusted according to the voltage of the transfer field, another parameter could be measured. For example, the resistance of the transfer drum could be measured directly (with difficulty) or the relative humidity (and temperature) measured directly. Sensing the voltage of the transfer field is easy and convenient and is therefore preferred.

The invention has been described in detail with particular reference to a preferred embodiment thereof, but it will be understood that variations and modifications can be effected within the spirit and scope of the invention as described hereinabove and as defined in the appended claims.

We claim:

1. In a method of forming a multicolor toner image on a receiving sheet, which method includes the steps of:

forming a plurality of toner images of a different color on a moving image member, moving a receiving sheet into a nip formed by a transfer drum and the image member, attracting the leading edge of the receiving sheet to the transfer drum by a vacuum applied through vacuum holes in said drum, applying an electric field in said nip of a direction and strength to transfer said toner image, and rotating the drum to bring the receiving sheet repeatedly into transfer relation with the toner images to transfer the toner images in registration to the receiving sheet, the improvement wherein said electric field applying step includes delaying the application of said electric field while the leading edge of said receiving sheet is associated with the nip by a delay time that is varied according to ambient relative humidity.

2. The method according to claim 1 further including the step of sensing a parameter associated with the applied electric field, which parameter is a function of the resistance of the transfer drum and adjusting said delay time as a function of said sensed parameter.

3. The method according to claim 2 wherein said delay time is adjusted to be shorter when said sensed parameter is indicative of a higher resistance of said transfer drum.

4. The method according to claim 2 wherein said field applying step includes applying a field which varies in voltage as the resistance of the transfer drum varies and said method includes sensing said voltage and delaying the application of said field inversely as the sensed voltage varies.

5. A method of transferring a toner image from an image member to a receiving sheet, said method comprising:

moving said receiving sheet into a nip formed by said image member and a transfer member, attracting the leading edge of a receiving sheet to the transfer member, applying an electric field in said nip of a direction and strength to transfer said toner image to the receiving sheet after a delay after the leading edge of said receiving sheet has entered said nip, and varying the size of said delay according to the ambient relative humidity.

6. A method of transferring a plurality of toner images from an image member to a receiving sheet, said method comprising:

moving said receiving sheet into a nip formed by said image member and a transfer member, said transfer member having one or more layers of intermediate resistance which resistance varies according to ambient conditions, attracting the leading edge of said receiving sheet to the transfer member, after a predetermined delay associated with a nominal position of said receiving sheet with respect to said nip, applying a voltage from a constant current source to said transfer member to create an electric field in said nip of a direction and strength to transfer a toner image to the receiving sheet, moving the transfer member through a path to bring the receiving sheet repeatedly through said nip to transfer the toner images to the receiving sheet, and sensing the voltage applied to said transfer member, and adjusting the delay as a function of said sensed voltage.

7. The method according to claim 6 wherein the delay is adjusted to change inversely as the voltage changes.

8. A method of transferring a toner image from an image member to a receiving sheet, said method comprising:

moving said receiving sheet into a nip formed by said image member and a transfer member, attracting the leading edge of the receiving sheet to the transfer member, applying an electric field in said nip of a direction and strength to transfer the toner image to the receiving sheet by applying a bias to said transfer member after a delay after a nominal point in time associated with the position of the leading edge in the nip, said transfer member having at least one layer of intermediate resistivity that helps establish said electrical field, and varying the size of the delay according to the resistance of said at least one layer of intermediate resistivity.

9. Apparatus for transferring a series of toner images in registration to a receiving sheet comprising:

a transfer drum having at least one set of vacuum holes, an image-bearing member forming a nip with said transfer drum, means for feeding a receiving sheet into said nip, means for applying a vacuum to said vacuum holes to secure a leading edge of said receiving sheet to said drum, means for applying an electric field to said nip of a direction urging toner to transfer from said image-bearing member to said receiving sheet, said means including means for reducing said field while the leading edge of a receiving sheet is being secured by said vacuum to the drum for the first time, and means for delaying the application of said electric field as a function of ambient relative humidity.

10. Apparatus for transferring a series of toner images in registration to a receiving sheet, comprising:

a transfer drum having a conductive core and one or more layers of intermediate conductivity surrounding said core, an image-bearing member having a conductive backing and forming a nip with said transfer drum, means for feeding a receiving sheet into said nip, means for applying an electrical potential between the core of said transfer drum and the conductive backing of said image member, said means including a constant current source for said potential, means for sensing the potential applied between said core and said backing and means for reducing the potential applied while the leading edge of a receiving sheet is attaching to said drum for a period of time which time is a function of said sensed potential.

11. Apparatus according to claim 10 wherein said period of time varies inversely with the potential sensed.

* * * * *